US006664223B2

(12) United States Patent
Zappone et al.

(10) Patent No.: US 6,664,223 B2
(45) Date of Patent: Dec. 16, 2003

(54) FABRIC CARE COMPOSITION CONTAINING POLYCARBOXYLATE POLYMER AND COMPOUND DERIVED FROM UREA

(75) Inventors: Marianne Zappone, Burlington, NJ (US); Dixie June Umstead, Edison, NJ (US); Marija Heibel, Highland Park, NJ (US); Sayed Ibrahim, Somerset, NJ (US)

(73) Assignee: Colgate-Palmolive Co., New York, NY (US)

( * ) Notice: Subject to any disclaimer, the term of this patent is extended or adjusted under 35 U.S.C. 154(b) by 0 days.

(21) Appl. No.: 10/229,200

(22) Filed: Aug. 27, 2002

(65) Prior Publication Data

US 2003/0144168 A1 Jul. 31, 2003

Related U.S. Application Data

(63) Continuation of application No. 09/634,211, filed on Aug. 9, 2000, now Pat. No. 6,502,325, which is a continuation-in-part of application No. 09/525,703, filed on Mar. 14, 2000, now abandoned, which is a continuation-in-part of application No. 09/388,698, filed on Sep. 2, 1999, now abandoned.

(51) Int. Cl.[7] ..... C11D 3/32; C11D 17/04; D06B 13/00

(52) U.S. Cl. ..... 510/337; 510/327; 510/361; 510/394; 510/405; 510/434; 510/438; 510/501; 510/515; 510/520; 510/522; 510/527; 252/8.61; 8/137

(58) Field of Search ..... 510/327, 337, 510/361, 394, 405, 434, 438, 515, 501, 520, 522, 527; 252/8.61; 8/137

(56) References Cited

U.S. PATENT DOCUMENTS 3,821,147 A * 6/1974 Dickson ..... 510/528
3,976,581 A * 8/1976 Rose ..... 510/521
3,993,830 A * 11/1976 Dickson et al. ..... 428/290
4,025,444 A * 5/1977 Murphy et al. ..... 510/332
4,134,838 A * 1/1979 Hooper et al. ..... 510/518
4,215,004 A * 7/1980 Borgerding et al. ..... 510/325
4,238,531 A * 12/1980 Rudy et al. ..... 427/242
4,532,064 A * 7/1985 Boskamp ..... 510/393
4,980,088 A * 12/1990 Boeckh et al. ..... 510/434
5,004,557 A * 4/1991 Nagarajan et al. ..... 510/337
5,501,806 A * 3/1996 Farooq et al. ..... 510/522
5,858,549 A * 1/1999 Kielbania, Jr. et al. .. 428/474.4
5,879,749 A * 3/1999 Rodrigues et al. ..... 427/393.2
5,965,466 A * 10/1999 Rodrigues et al. ..... 442/107
5,981,457 A * 11/1999 Ahmed ..... 510/223
6,123,739 A * 9/2000 Andrews et al. ..... 8/181

FOREIGN PATENT DOCUMENTS

WO WO 99/270550 A1 * 6/1999

* cited by examiner

*Primary Examiner*—Lorna M. Douyon
(74) *Attorney, Agent, or Firm*—Bernard Lieberman

(57) ABSTRACT

An aqueous fabric care composition for use in the wash or rinse cycle of a washing machine for cleaning or softening of fabrics concomitant with providing improved benefits to treated fabrics relating to moisture absorption, fragrance deposition, soil removal, reduced wrinkling prior to ironing and better appearance after ironing, said composition comprising:

(a) from about 0.1% to about 30%, by weight, of a surfactant selected from the group consisting of anionic, nonionic and cationic surfactants, and wherein said surfactant is not derived from hydrazine;

(b) from about 0.1% to about 5% by weight of (i) a polymer derived from a polycarboxylic acid; and (ii) a compound derived from urea; and (c) balance water and adjuvants.

13 Claims, No Drawings

FABRIC CARE COMPOSITION CONTAINING POLYCARBOXYLATE POLYMER AND COMPOUND DERIVED FROM UREA

This is a continuation of prior application Ser. No. 09/634,211 filed Aug. 9, 2000 now U.S. Pat. No. 6,502,325 which is a CIP of application Ser. No. 09/525,703 filed Mar. 14, 2000, now abandoned which in turn is a CIP of application U.S. Ser. No. 09/388,698, filed Sep. 2, 1999 now abandoned all of which applications are incorporated herein by reference.

The present invention relates to aqueous fabric care compositions for use in a wash or rinse bath which provide improved benefits to treated fabrics. More particularly, the present invention relates to fabric care compositions containing a polycarboxylate polymer with a urea-derived compound, which compositions impart to the treated fabric improved benefits relating to moisture absorption, fragrance deposition, soil removal, reduced wrinkling prior to ironing and better appearance after ironing.

BACKGROUND OF THE INVENTION

Fabric care compositions which provide softening in the wash cycle or rinse cycle of automatic laundry washing machines or in an aqueous wash/rinse bath are well known in the art. While these fabric care compositions are generally recognized as providing very good softening properties to treated fabrics, they nevertheless have certain drawbacks in terms of adversely affecting the treated fabrics with regard to properties such as moisture absorption, fragrance deposition and wrinkling of the fabric prior to ironing.

Starch and starch solutions are well known compositions to aid in removing wrinkles during ironing from fabrics which have been previously washed/rinsed using a variety of commercial laundry fabric care compositions. The use of such starch solutions, however does not overcome the aforementioned drawbacks associated with the use of commercial fabric softening compositions.

Polyacrylate type polymers have been incorporated into detergents for a variety of benefits. Typically, polyacrylate type polymers provide a cleaning benefit in detergents due to increased dispersancy of soil in the wash water, and due to inherent builder properties of such polymers. These types of polymers generally do not deposit on the fabric surface.

In an effort to improve the crease resistance and stain resistance of fabrics, U.S. Pat. No. 5,879,749 describes the use of a fabric treatment composition which contains a poly-functional molecule, such as derived from polyacrylic acid, in combination with a urea-derived compound. During pressing or ironing of the fabric, the urea-derived compound is said to crosslink the poly-functional molecule and thereby provide crease resistance to the fabric.

A class of polymers that are known to deposit out of the wash liquor onto the fabric surface are referred to as soil release polymers. These polymers are typically polyethylene terephalate/polyoxyethylene terephalate polymers that deposit on fabric, preferentially polyester fabrics. They act to make the surface more hydrophilic, so that oily soils may be more easily removed. However, the benefit of such polymers is limited to soil release, and even that benefit is limited primarily to polyester-containing fabrics.

The use of polycarboxylates in fabric softener compositions is known. U.S. Pat. Nos. 4,043,965; 3,993,830 and 3,821,147 assigned to Colgate-Palmolive describe softener compositions containing a polyacrylate polymer to provide soil release benefits. The described compositions are maintained at a pH of below 3 so as to render the polymer insoluble when added to the rinse bath allowing it to deposit on the fabrics.

Accordingly, there is no recognition in the prior art of being able to deposit a polyacrylate-based material out of a wash or rinse liquor onto a fabric surface over a broad range of pH so as to provide a wide variety of significant fabric care benefits to treated fabrics, unrelated to detergency.

SUMMARY OF THE INVENTION

The present invention provides an aqueous fabric care composition for use in the wash or rinse cycle of a washing machine for cleaning or softening of fabrics concomitant with providing improved benefits to treated fabrics relating to moisture absorption, fragrance deposition, soil removal, reduced wrinkling prior to ironing and better appearance after ironing, said composition comprising:

(a) from about 0.1% to about 30%, by weight, of a surfactant selected from the group consisting of anionic, nonionic and cationic surfactants, and wherein said surfactant is not derived from hydrazine;

(b) from about 0.1% to about 5% by weight of (i) a polymer derived from a polycarboxylic acid; and (ii) a compound derived from urea; and (c) balance water and adjuvants.

The present invention is predicated on the discovery that the use of the fabric care compositions of the invention in an aqueous wash bath or rinse bath, enables an effective amount of the polymer and urea-derived compound to deposit on the fabric surface and thereby provide the aforementioned fabric care benefits to the treated fabric. In contrast with the prior art which exemplifies applying a fabric treatment solution containing a polyacrylic acid polymer but in the absence of surfactant directly to the fabric by spraying with a pump or aerosol spray, the present compositions are able to effect deposition on fabric in the wash cycle or rinse cycle of a washing machine. Although applicants do not wish to be bound by any theory of operation, it is believed that the presence of a surfactant in the compositions of the invention serve a two-fold purpose: it facilitates deposition of polymer out of the wash or rinse bath and onto the fabric; and it provides improved fabric care benefits which have heretofore not been provided or appreciated using conventional fabric treating compositions.

It is believed that prior to ironing the fabric, the urea-derived compound does not crosslink (the crosslinking reaction being heat activated) but the polymer/urea-derived compound composition nevertheless is able to provide reduced wrinkling of fabric prior to ironing. It is hypothesized that the reduction in wrinkling is due to preferential hydrogen bonding between the polymer/urea-derived compound composition and the cellulose fibers of the cotton fabric, as opposed to intra-cellulose fiber hydrogen bonding. The intra-cellulose fiber hydrogen bonding, following distortion of the fabric geometry during washing/rinsing, is part of the mechanism for wrinkle formation. By reducing the level of intra-cellulose fiber hydrogen bonding by use of the present invention, the number of wrinkles that remain in fabric as it dries is significantly reduced.

Finally, during ironing of the fabric, the urea-derived compound is activated. The urea-derived compound then bonds together the polymer chains, forming a stiff film on the fabric surface. This is believed to effectively keep the fabric in the conformation it is forced into via ironing.

DETAILED DESCRIPTION OF THE INVENTION

The polymers useful for the present invention are derived from a polycarboxylic acid. They can be prepared by polymerizing or copolymerizing suitable unsaturated monomers, preferably in their acid form. Unsaturated monomeric acids that can be polymerized to form suitable polymers include but are not limited to acrylic acid, methacrylic acid, maleic acid (or maleic anhydride), fumaric acid, itaconic acid, aconitic acid, mesaconic acid, citraconic acid and methylenemalonic acid.

Particularly suitable polymeric polycarboxylates can be derived from acrylic acid. Such acrylic acid-based polymers which are useful herein are the water-soluble salts of polymerised acrylic acid. The average molecular weight of such polymers in the acid form preferably ranges from 2,000 to 10,000, more preferably from 4,000 to 7,000 and most preferably from 4,000 to 5,000. Water-soluble salts of such acrylic acid polymers can include, for example, the alkali metal, ammonium and substituted ammonium salts. Soluble polymers of this type are known materials.

Acrylic/maleic-based copolymers may also be used. Such materials include the water-soluble salts of copolymers of acrylic acid and maleic acid. The average molecular weight of such copolymers in the acid form preferably ranges from 2,000 to 100,000, more preferably from 5,000 to 75,000, most preferably from 7,000 to 65,000. The ratio of acrylate to maleate segments in such copolymers will generally range from 30:1 to 1:1, more preferably from 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in EP 193,360 published Sep. 3, 1986.

The compounds of the present invention are derived from urea. The preferred compounds for use herein are derived from urea and contain at least two hydroxyl groups. The hydroxyalkyl ureas (HAU) such as N,N-bis(2-hydroxyethyl) urea are especially preferred. Exemplary HAU compounds include, but are not limited to, N,N-bis(2-hydroxyethyl) urea, tetrakis(2-hydroxyethyl)urea, tris(2-hydroxyethyl) urea, N,N'-bis(2-hydroxyethyl)urea, N,N'-bis(3-hydroxypropyl)urea, N,N'-bis(4-hydroxybutyl)urea and 2-urea-2-ethyl-1,3-propanediol.

The compositions of the invention can be used in the wash cycle or rinse cycle of an automatic laundry washing machine or in an aqueous wash bath or rinse bath during hand laundering.

When used in a rinse bath or in the rinse cycle of a laundry washing machine, the compositions contain a cationic surfactant fabric softener, excluding hydrazine derivatives.

The fabric softening compound which is useful in the compositions of the invention is a fabric substantive quaternary ammonium compound or an amine compound suitable for conditioning fabrics.

A preferred softening compound is a biodegradable fatty ester quaternary ammonium compound of Formula II:

(II)

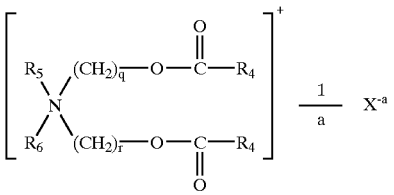

wherein each $R_4$ independently represents an aliphatic hydrocarbon group having from 8 to 22 carbon atoms, $R_5$ represents $(CH_2)_s$—$R_7$ where $R_7$ represents an alkoxy carbonyl group containing from 8 to 22 carbon atoms, benzyl, phenyl, $(C_1$–$C_4)$-alkyl substituted phenyl, OH or H; $R_6$ represents $(CH_2)_t$ $R_8$ where $R_8$ represents benzyl, phenyl, $(C_1$–$C_4)$ alkyl substituted phenyl, OH or H; q, r, s and t, each independently, represent a number of from 1 to 3; and x is an anion of valence a.

The fatty ester quaternary compounds are preferably diester compounds, i.e. $R_7$ represents benzyl, phenyl, phenyl substituted by $C_1$–$C_4$ alkyl, hydroxyl (OH) or hydrogen (H). Most preferably $R_7$ represent OH or H, especially preferably OH, e.g. $R_5$ is hydroxyethyl.

q, r and s, each, independently, represents a number of from 1 to 3.

X represents a counter ion of valence a. For example, the diester quat may be a compound of the formula:

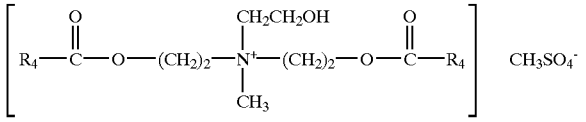

where each $R_4$ may be, for example, derived from hard or soft tallow, coco, stearyl, oleyl, and the like. Such compounds are commercially available, for example, Tetranyl AT1-75, from Kao Corp. Japan, which is di-tallow ester triethanol amine quaternary ammonium methyl sulfate. Tetranyl AT1-75 is based on a mixture of about 25% hard tallow and about 75% soft tallow. A second example would be Hipochem X-89107, from High Point Chemical Corporation.

Another preferred fabric softening compound is an amido (or ester) tertiary amine which is an inorganic or organic acid salt of Formula (III):

(III)

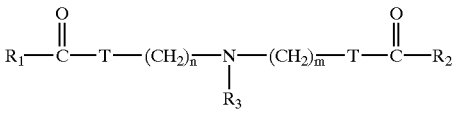

wherein $R_1$ and $R_2$ independently represent $C_{12}$ to $C_{30}$ aliphatic hydrocarbon groups, $R_3$ represents $(CH_2CH_2O)_pH$, $CH_3$ or H; T represents NH; n is an integer from 1 to 5, m is an integer from 1 to 5, and p=1 to 10.

$R_3$ in formula (III) represents $(CH_2CH_2O)_pH$, $CH_3$, or H, or mixtures thereof. When $R_3$ represents the preferred $(CH_2CH_2O)_pH$ group, p is a positive number representing the average degree of ethoxylation, and is preferably from 1 to 10, especially 1.4 to 6, and more preferably from about 1.5 to 4, and most preferably, from 1.5 to 3.0. n and m are integers of from 1 to 5, preferably 1 to 3, especially 2. The compounds of formula (III) in which $R_3$ represents the preferred $(CH_2CH_2O)_pH$ group are broadly referred to herein as ethoxylated anidoamines (when T=NH) or ethoxylated ester amines (when T=O), and the term "hydroxyethyl" is also used to describe the $(CH_2CH_2O)_pH$ group.

Most especially preferred is the compound of formula (III) which is commercially available under the tradenames Varisoft 512 (a 90% concentration with a 10% organic solvent), or Varisoft 511 (approximately a 100% active ingredient concentration), available from Witco Chemical Company, which is bis(tallow-amidoethyl)-hydroxyethyl amine of the following formula $$((\text{Tallow})\text{-}\overset{\overset{\displaystyle O}{\|}}{C}\text{—}NH\text{—}CH_2CH_2)_2\text{—}N\text{—}(CH_2CH_2O)_XH \quad (X = 1.5 \text{ to } 3.0)$$

In the non-neutralized (non-protonated) form the fatty amide or fatty ester tertiary amine compounds are hardly or not at all dispersible in water. Therefore, in the present invention, the amine function of the amidoamine or ester amine compound is at least partially neutralized by a proton contributed by a dissociable acid, which may be inorganic, e.g., HCl, $H_2SO_4$, $HNO_3$, etc. or organic, e.g. acetic acid, propionic acid, lactic acid, citric acid, glycolic acid, toluene sulfonic acid, maleic acid, fumaric acid, and the like. Mixtures of these acids may also be used, as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent.

The amount of acid used will depend on the "strength" of the acid; strong acids such as HCl, and $H_2SO_4$ completely dissociate in water, and, therefore, provide a high amount of free protons ($H^+$), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

Furthermore, the amount of acid used for neutralization should be sufficient to provide at least a 0.5:1 molar ratio, and up to about a 1:1 molar ratio of the acid to the total amount of fabric softener fatty amide or ester tertiary amine. For the organic carboxylic acids, however, it is preferred to use a molar excess of the neutralizing acid. Molar ratios of organic carboxylic acid to the compound of formula (III) up to about 6:1, for example from 1.5:1 to 6:1, such as 2:1, 3:1 or 4:1, have been found advantageous in terms of stability and/or softening performance. The use of glycolic in molar excess is especially preferred.

Another preferred class of fabric softening compound for use herein is the class of compounds known as alkyl quaternary amines, commonly referred to as "quats" by those skilled in the art. Other softening compounds which are known to those skilled in the art may also be included in the fabric care compositions for purposes of the invention.

The emulsifier used in the present fabric softening compositions is required to stabilize the composition and prevent phase separation. The fatty alcohol ethoxylates useful for this purpose correspond to ethylene oxide condensation products of higher fatty alcohols, with the higher fatty alcohol being of from about 9 to 15 carbon atoms and the number of ethylene oxide groups per mole being from about 10 to 30. In the preferred fatty alcohol ethoxylates for use herein, the alkyl chain length ranges from about 13 to 15 carbon atoms and the number of ethylene groups ranges from about 15 to 20 per mole. Especially preferred for use herein is Synperonic A20 manufactured by ICI Chemicals, such nonionic surfactant being an ethoxylated $C_{13}$–$C_{15}$ fatty alcohol with 20 moles of ethylene oxide per mole of alcohol and having an HLB of 8.25.

When used in a wash bath or in the wash cycle of a laundry washing machine, the compositions contain an anionic and/or a nonionic surfactant.

Among the anionic surface active compounds useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulfonate, sulfate, carboxylate, phosphonate and phosphate so as to form a water-soluble detergent.

Examples of suitable anionic detergents include soaps, such as, the water-soluble salts (e.g., the sodium potassium, ammonium and alkanol-ammonium salts) of higher fatty acids or resin salts containing from about 8 to 20 carbon atoms and preferably 10 to 18 carbon atoms. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an aliphatic, preferably an alkyl radical containing from about 8 to 26, and preferably from about 12 to 22 carbon atoms. Examples of the sulfonated anionic detergents are the higher alkyl aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of from about 6 to 23 carbons and $R_1$ is an alkyl group containing from about 1 to 17 carbon atoms, or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites.

Other suitable anionic detergents are sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about ⅕ to ½ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms. The proportion of ethylene oxide in the polyethoxylated higher alkanol sulfate is preferably 2 to 5 moles of ethylene oxide groups per mole of anionic detergent, with three moles being most preferred, especially when the higher alkanol is of 11 to 15 carbon atoms. A preferred polyethoxylated alcohol sulfate detergent is marketed by Shell Chemical Company as Neodol 25-3S.

The most highly preferred water-soluble anionic detergent compounds are the ammonium and substituted ammonium (such as mono, di and tri ethanolamine), alkali metal (such as, sodium and potassium) and alkaline earth metal (such as, calcium and magnesium) salts of the higher alkyl benzene sulfonates, olefine sulfonates and higher alkyl sulfates. Among the above-listed anionics, the most preferred are the sodium linear alkyl benzene sulfonates (LABS), and especially those wherein the alkyl group is a straight chain alkyl radical of 12 or 13 carbon atoms.

Any suitable nonionic detergent compound may be used as a surfactant in the present compositions, with many members thereof being described in the various annual issues of *Detergents and Emulsifiers,* by John W. McCutcheon. Such volumes give chemical formulas and trade names for commercial nonionic detergents marketed in the United States, and substantially all of such detergents can be employed in the present compositions. However, it is highly preferred that such nonionic detergent be a condensation product of ethylene oxide and higher fatty alcohol (although instead of the higher fatty alcohol, higher fatty acids and alkyl [octyl, nonyl and isooctyl] phenols may also be employed). The higher fatty moieties, such as the alkyls, of such alcohols and resulting condensation products, will normally be linear, of 10 to 18 carbon atoms, preferably of 10 to 16 carbon atoms, more preferably of 12 to 15 carbon atoms and sometimes most preferably of 12 to 14 carbon atoms. Because such fatty alcohols are normally available commercially only as mixtures, the numbers of carbon atoms given are necessarily averages but in some instances the ranges of numbers of carbon atoms may be actual limits for the alcohols employed and for the corresponding alkyls.

The ethylene oxide (EtO) contents of the nonionic detergents will normally be in the range of 3 to 15 moles of EtO per mole of higher fatty alcohol, although as much as 20 moles of EtO may be present. Preferably such EtO content will be 3 to 10 moles and more preferably it will be 6 to 7 moles, e.g., 6.5 or 7 moles per mole of higher fatty alcohol (and per mole of nonionic detergent). As with the higher fatty alcohol, the polyethoxylate limits given are also limits on the averages of the numbers of EtO groups present in the condensation product. Examples of suitable nonionic detergents include those sold by Shell Chemical Company under the trademark Neodol®, including Neodol 25-7, Neodol 23-6.5 and Neodol 25-3.

Other useful nonionic detergent compounds include the alkylpolyglycoside and alkylpolysaccharide surfactants, which are well known and extensively described in the art.

The preferred alkyl polysaccharides for use herein are alkyl polyglucosides having the formula $$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to 18, preferably from about 12 to about 14 carbon atoms; n is 2 or 3 preferably, 2; r is from 0 to 10, preferably 0; and x is from 1.5 to 8, preferably from 1.5 to 4, most preferably from 1.6 to 2.7. To prepare these compounds, a long chain alcohol ($R_2OH$ where $R_2$ is an alkyl group of about $C_{10}$ to $C_{18}$) can be reacted with glucose, in the presence of an acid catalyst to form the desired glucoside. Alternatively, the alkyl polyglucosides can be prepared by a two step procedure in which a short chain alcohol ($R_1OH$ wherein $R_1$ is an alkyl having from 1 to 6 carbon atoms) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

EXAMPLE 1

Reduced Wrinkling After Ironing for Polymer-Containing Liquid Detergent

The purpose of this example was to demonstrate the benefits of reduced wrinkling and improved crease resistance after ironing for a heavy duty liquid detergent containing the fabric care compositions of the invention when used in the wash cycle of an automatic washing machine. The following compositions were prepared as shown in Table 1. Samples 1 and 3 are comparative compositions, while Samples 2 and 4 are compositions in accordance with the invention.

TABLE 1

| Ingredient % | Sample 1 | Sample 2 | Sample 3 | Sample 4 |
|---|---|---|---|---|
| C13–15 7 EO Ethoxylated Alcohol | 8.0 wt % | 8.0 wt % | 5.07 wt % | 5.07 wt % |
| C12–14 3 EO Alcohol Sulfate | 2.0 | 2.0 | 3.4 | 3.4 |
| Sodium C12–14 Benzene Sulfonate (NaLAS) | 8.3 | 8.3 | 9.00 | 9.00 |
| Sodium Citrate | — | — | 2.046 | 2.046 |
| Sodium Silicate | 2.0 | 2.0 | — | — |
| Ethanol | 2.0 | 2.0 | 0.25 | 0.25 |
| Minors | ~1.0 | ~1.0 | ~1.00 | ~1.0 |
| Polymer/urea-derived compound composition* (50% active) | — | 2.0 | — | 2.0 |

*The polymer/urea-derived compound composition was comprised of 16.7 g of Alcosperse 602N poly(acrylic acid) having an average molecular weight of 4,500–5,000 (available from Alco Chemical Company, Chattanooga, TN) (45% active) and 1.0 g of dihydroxyethyl urea (85% active). The mixture was stirred together until a solution was formed. This is a 50% active solution.

For each Sample, ten 10"×10" cotton percale swatches were prepared by washing in a 17 gallon top loading washing machine set for hot wash, with 80 g of a U.S. commercial super-concentrated heavy duty detergent powder. After the wash cycle was over, the swatches were dryed in an electric clothes dryer, and laid flat for storage.

The swatches were added to a 4 lb ballast load of clothes, and the whole load was washed in a 17 gallon top loading washing machine. The loads were washed on the hot setting (~120 F.), 100 ppm hardness for a 10 minute wash cycle, using 120 g detergent. Nothing was added to the rinse cycle. The wash cycle was repeated for a total of two cycles, and five swatches from each cycle were line dryed and five were dryer dried. After drying overnight, the swatches were laid flat for storage. The swatches were ironed on the cotton setting using steam for ~30 seconds each. After ironing the swatches were compared visually by a ten member panel to determine which had fewer wrinkles. The panel was con ducted under controlled lighting conditions. The results are listed in Table 2.

TABLE 2

| Cotton | Sample 1 vs. Sample 2 "Which looks less wrinkled?" | | Sample 3 vs. Sample 4 "Which looks less wrinkled?" | |
|---|---|---|---|---|
| Swatches | Sample 1 | Sample 2 | Sample 3 | Sample 4 |
| 1 | 0 | 10 | 0 | 10 |
| 2 | 1 | 9 | 0 | 10 |
| 3 | 0 | 10 | 0 | 10 |
| 4 | 1 | 9 | 0 | 10 |
| 5 | 0 | 10 | 0 | 10 |
| 6 | 0 | 10 | 2 | 8 |
| 7 | 3 | 7 | 1 | 9 |
| 8 | 1 | 9 | 0 | 10 |
| 9 | 0 | 10 | 1 | 9 |
| 10 | 3 | 7 | 0 | 10 |
| Winner | Sample 2 | | Sample 4 | |

As shown in Table 2 for both types of HDL formulas tested, the swatches washed in the compositions of the invention (Samples 2 and 4) showed significantly fewer wrinkles after ironing than the swatches washed in the comparative compositions (Samples 1 and 3).

EXAMPLE 2

Reduced Wrinkling After Ironing for Polymer-Containing Fabric Softener

The purpose of this example was to determine the benefits of reduced wrinkling and improved crease resistance after ironing for a fabric care composition of the invention containing a cationic fabric softener for use in the rinse cycle of a washing machine. The following compositions were prepared as shown in Table 3. Sample 5 is a comparative composition, while Sample 6 is a composition of the invention.

TABLE 3

| Ingredient | Sample 5 | Sample 6 |
|---|---|---|
| C13–15 20 EO alcohol nonionic surfactant | 0.20 wt % | 0.20 wt % |
| C16–18 Ester Quaternary ammonium methylsulfate Cationic Softener | 3.30 | 3.30 |
| C16–18 Fatty Alcohol | 0.83 | 0.83 |
| Minors | ~0.5 | ~0.5 |
| Polymer/urea-derived compound composition* (50% active) | — | 2.0 |
| Water | QS | QS |

*The polymer/urea-derived compound composition is the same as that described in Example 1.

For each Sample, twenty 10"×10" cotton percale swatches were prepared by washing in a 17 gallon top loading washing machine set for hot wash, with 80 g US Tide SCHDD. After the wash cycle was over, the swatches were dryed in an electric clothes dryer, and laid flat for storage.

The swatches were washed in a 17 gallon top loading washing machine. The loads were washed on the hot setting (~120 F.), 100 ppm hardness for a 10 minute wash cycle, using 62 g of a commerical phosphate-built, anionic powder detergent. To the rinse cycle there was added 110 mL of the softener products. Five swatches from each cycle were line dryed and five were dryer dried. After drying overnight, the swatches were laid flat for storage. The swatches were ironed on the cotton setting using steam for ~30 seconds each. After ironing the swatches were compared visually by a twenty member panel to determine which had fewer wrinkles. The panel was conducted under controlled lighting conditions. The results are listed in Table 4.

TABLE 4

| "Which irons easier/less wrinkles?" | Preference | Confidence |
|---|---|---|
| Line dried swatches | Sample 6 | 90% |
| Dryer dried swatches | Sample 6 | 90% |

As shown in Table 4, the swatches washed in detergent+softener with the composition of the invention (Sample 6) were chosen by members of the panel to iron easier/have fewer wrinkles than those washed in the comparative composition (Sample 5).

EXAMPLE 3

Reduced Wrinkling Prior to Ironing

Fabric softening compositions were formulated as shown in Table 5. Samples 7, 9 and 10 are comparative compositions, while Sample 8 is a fabric care composition of the invention.

TABLE 5

| Ingredient | Sample 7 | Sample 8 | Sample 9 | Sample 10 |
|---|---|---|---|---|
| C13–15 20 EO alcohol nonionic surfactant | 0.20 wt % | 0.20 wt % | 0.20 wt % | 0.20 wt % |
| C16–18 Ester Quaternary ammonium methylsulfate Cationic Softener | 3.30 | 3.30 | 3.30 | 3.30 |
| C16–18 Fatty Alcohol | 0.83 | 0.83 | 0.83 | 0.83 |
| Minors | ~0.5 | ~0.5 | ~0.5 | ~0.5 |
| Polymer/urea-derived compound composition* (50% active) | — | 2.0 | — | — |
| Polyacrylic acid MW 4500 (Acusol 445) | — | — | 1.0 | — |
| Terpolymer (Alcosperse 408) | — | — | — | 1.0 |
| Water | QS | QS | QS | QS |

*The polymer/urea-derived compound composition is the same as that described in Example 1.

One ladies 100% cotton white blouse (Land's End) for each sample was prepared by washing in a 17 gallon top loading washing machine at 55 C with 80 g of a U.S. commercial SCHDD powder and then dried in an electric clothes dryer.

The blouses for each sample were washed for a 10 minute wash cycle in a 17 gallon top loading washing machine with 120F water using 62 g of the aforementioned SCHDD powder with a 4 lb ballast. To remove excess foam, the loads were given two rinses. The softener compositions (85 mL) were added to the second rinse, and the rinse cycle was 2 minutes (cycle of the machine). The items were then removed from the wash, and the wash/rinse cycle was repeated using the same products. After the second cycle, the items were line dried overnight. The blouses were hung up prior to visual evaluation.

The blouses were individually compared by a ten member panel in a paired comparison to answer the question, "Which looks less wrinkled?" The results are noted in Table 6.

TABLE 6

| Ladies Blouse | Sample 7 vs. Sample 8 | Sample 7 vs. Sample 9 | Sample 7 vs. Sample 10 | Sample 8 vs. Sample 9 | Sample 8 vs. Sample 10 |
|---|---|---|---|---|---|
| Score | 0 vs. 10 | 0 vs. 6 4 no preference | 2 vs. 2 6 no preference | 9 vs. 0 1 no preference | 10 vs. 0 |
| Winner | Sample 8 | Parity | Parity | Sample 8 | Sample 8 |

As shown in Table 6 the garments washed in comparative compositions containing polyacrylate or terpolymer (Samples 9 and 10) showed no reduction in wrinkles vs. a comparative composition containing no polymer (Sample 7). The garments washed in the composition of the invention containing the polymer/urea-derived compound composition (Sample 8) showed a statistically significant reduction in wrinkles vs all 3 comparative compositions.

EXAMPLE 4

Improved Moisture Transport Properties

Fabric care compositions for use in the rinse cycle were provided as shown in Table 7. Sample 11 is a comparative composition, while Sample 12 is a composition in accordance with the invention.

TABLE 7

| Ingredient | Sample 11 | Sample 12 |
|---|---|---|
| C13–15 20 EO alcohol nonionic surfactant | 0.20 wt % | 0.20 wt % |
| C16–18 Ester Quaternary ammonium methylsulfate Cationic Softener | 3.30 | 3.30 |
| C16–18 Fatty Alcohol | 0.83 | 0.83 |
| Minors | ~0.5 | ~0.5 |
| Polymer/urea-derived compound composition* (50% active) | — | 2.0 |
| Water | QS | QS |

*The polymer/urea-derived compound composition is the same as described in Example 1.

Ten 10"×10" cotton percale swatches were included as tracers in a 4 lb ballast load of various clothing for each sample. The laundry loads were washed in a 17 gallon top loading washing machine in hot water with 80 g of a commercial detergent. 85 mL of the softener compositions were added to the rinse cycle for a 2 minute rinse (rinse cycle time of the machine). The loads were dried in an electric clothes dryer in between wash/rinse cycles. The loads were wash/rinse/dried through multiple cycles.

Moisture transport in the fabric was tested by placing the cotton percale tracer flat on a aluminum foil surface, and measuring the time needed for a drop of blue-dyed water to spread out on the surface and adsorb. Ten replicates were measured for each sample. The results are as shown in Table 8.

TABLE 8

| Number of Cycles | Average Absorption Time Sample 11 | Average Absorption Time Sample 12 |
|---|---|---|
| 10 | 15.1 seconds | 1.6 seconds |
| 15 | 13.4 seconds | 1.2 seconds |
| 20 | 26.8 seconds | 1.4 seconds |

As shown in Table 8, after only 10 cycles, the swatches washed in the composition of the invention (Sample 12) demonstrated significantly improved moisture transport compared to the control (Sample 11).

EXAMPLE 5

Effect of Polymer/Urea-Derived Compound Composition Alone in Rinse Cycle

The purpose of this example was to determine if any benefit is provided by the use of a polymer/urea-derived compound compositions in the absence of a surfactant (comparative compositions) when diluted in an aqueous wash/rinse bath into which fabrics are immersed. Compositions were provided as shown in Table 9.

TABLE 9

| Ingredients | Sample 13 | Sample 14 | Sample 15 |
|---|---|---|---|
| Polymer/urea-derived compound composition* (50% active) | — | 2.0 wt % | 2.0 wt % |
| Citric acid (50% active) | — | 0.13 | — |
| Sodium carbonate | — | — | 5.0 |
| Water | 100 | QS | QS |
| pH | | 7.2 | 11.5 |

*The polymer/urea-derived compound composition is the same as that described Example 1.

Ten 10"×10" cotton percale swatches per sample were prepared by washing in 55 C water with 90 g of a U.S. commercial SCHDD powder in a top loading, 17 gallon washing machine. The swatches were dryer dried and laid flat prior to use.

The swatches were then washed in a 17 gallon top loading machine at 120F for 10 minutes. 62 g of the SCHDD powder was used as the detergent. The swatches were put through a preliminary rinse to remove excess detergent. In the second rinse 110 mL of the sample compositions were added. The rinse cycle was 2 minutes (cycle time of the machine). After the wash/rinse cycle was over, the wash/rinse cycle was repeated. After the second cycle, the swatches were dried (5 of each set line dried, 5 of each set dryer dried). After drying, the swatches were laid flat and stored in an air-tight plastic Ziploc bag.

Visual evaluation of the swatches showed no wrinkle reduction for Samples 14 and 15 vs. Sample 13 (water alone). Even after ironing, which typically increases the differences, visual comparison by a ten member panel shows no significant differences for the polymer/urea-derived compound composition rinses (Samples 14 and 15) vs. water rinse (Sample 13). As a last resort, ESCA analysis was performed on the cotton percale swatches to determine if any deposition of the polymer/urea-derived compound composition occurred. ESCA results show no deposition of the polymer on the cloth for Samples 14 and 15.

Based on the above, it is noted that addition of the polymer alone (in the absence of a surfactant) to the wash/rinse bath at levels similar to that used in compositions of the invention did not provide the benefits previously observed with the compositions of the invention, as demonstrated in Examples 1 through 4.

EXAMPLE 6

Improved Fragrance Deposition onto Fabric

The purpose of this example was to demonstrate that the composition of the invention provides improved fragrance deposition on fabric when used in the rinse cycle of a washing machine. Compositions were prepared as shown in Table 10. Sample 16 is a comparative composition, while Sample 17 is a composition of the invention.

TABLE 10

| Ingredient | Sample 16 | Sample 17 |
|---|---|---|
| C16–18 Ester Quaternary ammonium methylsulfate Cationic Softener | 8.0 wt % | 8.0 wt % |
| C13–15 20 EO nonionic alcohol | 0.3 | 0.3 |
| Fragrance | 0.75 | 0.75 |
| Polymer/urea-derived compound composition* (50% active) | — | 2.0 |
| Water | QS | QS |

*The polymer/urea-derived compound composition is the same as that described in Example 1.

Twelve cotton terrycloth hand towels for each sample were prepared by washing twice in hot water with 120 mL of unfragranced powder detergent, followed by three rinses. Twelve towels per sample were then washed with a 5 lb ballast load. The loads were washed with 92 g of a U.S. commercial BDL (unfragranced) under US conditions (57 L top loading machine, 100 ppm hardness, 95 F.). Fabric softeners prepared in Sample 16 and 17 were then added to the rinse cycle for a 2 minute rinse. The wash/rinse process was repeated three times for each sample. The loads were then dryer dried, and aged for three days in a 40% relative humidity chamber. After aging, the two samples were compared for fragrance intensity by a trained seven-member panel. The results are as shown in Table 11.

TABLE 11

| | Sample 16 | Sample 17 |
|---|---|---|
| Number of Votes for Most Intense Fragrance | 2 | 5 |

As shown in Table 11, the trained panel chose the towels washed in the composition of the invention (Sample 17) to have greater fragrance intensity (therefore greater fragrance deposition on the fabric) than towels washed in the comparative composition (Sample 16).

EXAMPLE 7

Improved Soil Removal Benefits

The purpose of this example was to demonstrate that compositions of the invention provide significantly improved soil release benefits during laundering relative to comparative compositions which are identical in composition except for the absence of the polymer/urea-derivative composition.

Samples 18–23 were prepared as shown in Tables 12, 13 and 14, respectively wherein samples 18, 20 and 22 are compositions of the invention while Samples 19, 21 and 23 are control compositions.

TABLE 12

Liquid Fabric Softener

| Ingredient | Sample 18 | Sample 19 |
|---|---|---|
| Di-tallow ester quatenary ammonium methylsulfate (Tetranyl AT2-75 from Kao) | 3.30 wt % | 3.30 wt % |
| Ethoxylated alcohol (Neodol L25-7 nonionic) | 1.0 | 1.0 |
| Fatty alcohol | 0.83 | 0.83 |
| Polymer/urea-derivative compound composition* (50% active) | 10 | — |
| Deionized water | balance | balance |

*The polymer/urea-derivative compound composition is the same as that described in Example 1.

TABLE 13

Liquid Detergent

| Ingredient | Sample 20 | Sample 21 |
|---|---|---|
| Sodium $C_{12}$–$C_{14}$ alkyl benzene sulfonate (anionic) | 8.3 wt % | 8.3 wt % |
| $C_{12}$–$C_{14}$ 3 EO alcohol sulfate | 2.0 | 2.0 |
| Ethoxylated alcohol (neodol L25-7 nonionic) | 8.0 | 8.0 |
| Sodium silicate | 2.0 | 2.0 |
| Polymer/urea-derivative compound composition* (50% active) | 2.0 | — |
| Water | balance | balance |

*The polymer/cross-linking compound composition is the same as that described in Example 1.

TABLE 14

Powder Heavy Duty Detergent

| Ingredient | Sample 22 | Sample 23 |
|---|---|---|
| Sodium $C_{12}$–$C_{14}$ alkyl benzene sulfonate (anionic) | 20.0 wt % | 20.0 wt % |
| Sodium phosphate | 21.0 | 21.0 |
| Sodium polyacrylate | 2.0 | 2.0 |
| Sodium carbonate | 9.0 | 9.0 |
| Polymer/urea-derivative composition* (50% active) | 2.0 | — |
| Water and filler | | balance |

*The polymer/urea-derivative composition is the same as that described in Example 1.

The test protocol for testing Samples 18 and 19, the liquid fabric softeners was as follows:

A machine wash of 42 liter/wash was conducted, 5 minute cycle, 3 prewashes, 77° F., U.S. tap water (100 ppm hardness). Dosage was 55 grams per wash.

The test procedure consisted of the following steps:

1. Cotton percale swatches were first washed with a commercial heavy duty liquid detergent, rinsed and dryer dried.
2. The machine was filled with water and Samples 18 and 19 were added each in a separate machine. The swatches were washed in the softener solution for 5 minutes with no rinsing followed by dryer drying. Step 2 was repeated three times 3. Twenty-four swatches of different fabrics were stained for each sample with the soils/stains identified below.
4. The swatches were left to dry overnight.
5. The swatches were washed in a commerical washing machine using a commercial detergent not containing the polymer/urea-derivative composition. The swatches were then dried in an electric dryer and the reflectance measured using a Hunter reflectometer.

The test protocol for testing Samples 20, 21, 22 and 23 was as follows:

A Maytag top loading machine was used; 17 gallons, regular cycle, 77° F., U.S. tap water (100 ppm hardness).

1. The machine was filled with water and samples 20, 21, 22, and 23 were added each in a separate machine. The swatches were washed in the detergent solution for complete regular cycle (10 minutes) with rinsing followed by electric dryer drying.
2. Step one was repeated three times.
3. Twenty-four swatches of different fabrics were stained for each sample with the soils (stains identified below).
4. The swatches were left to dry overnight.
5. The swatches were finally washed in a commercial washing machine using commercial detergent not containing the polymer/urea-derived composition. The swatches were then dried in an electric commercial dryer and the reflectance was measured using a Hunter reflectometer.
6. The calculation of % Soil Removal is shown below.

Calculation of % Soil Removal (SR)

1. Twenty-four swatches of different fabrics were first washed 3 times at 10 minutes/wash in the respective liquid or powder detergent.
2. The reflectance of the freshly washed swatches was measured to obtain Lc.
3. The prewashed swatches were stained with stains described below, and allowed to set overnight.
4. The reflectance of the soiled/stained swatches was measured to obtain Ls.
5. The stained swatches were then washed one time in a commercial detergent not containing the polymer/copolymer system.
6. The reflectance of the freshly washed swatches was then measured to obtain Lw.
7. The percent Soil Release (% SR) was calculated as follows:

$$\% SR=[(Lw-Ls)/(Lc-Ls)]\times 100$$

The following soils/stains were used:

Motor Oil on Cotton

Motor Oil on 65D/35C (Dacron/Cotton)

Lard on Cotton

Lard on 65D/35C

Spaghetti Sauce on Cotton

Spaghetti Sauce on 65D/35C

Sebum Particulate on Cotton

Sebum Particulate on 65D/35C

The dosages used in the test protocol were as follows:

Samples 20 and 21—124 grams

Samples 22 and 23—192 grams

The test results are shown in Tables 15 and 16 below.

TABLE 15

Soil Release Performance Without Ironing

| % SR | Sample 18 | (Control) 19 | 20 | (Control) 21 | 22 | (Control) 23 |
|---|---|---|---|---|---|---|
| % SR | 504.36 | 481.42 | 505.0 | 483.7 | 494.9 | 489.9 |
| Δ % SR | 22.93 | — | 21.30 | — | 5.0 | — |

TABLE 16

Soil Release Performance With Ironing

| % SR | Sample 18 | (Control) 19 | 20 | (Control) 21 | 22 | (Control) 23 |
|---|---|---|---|---|---|---|
| % SR | 498.74 | 473.00 | 461.27 | 433.39 | 471.28 | 458.62 |
| Δ % SR | 25.74 | — | 27.88 | — | 12.66 | — |

Based on the results shown above, the % SR for each of the compositions of the invention is significantly improved relative to the respective control compositions both for ironed fabrics and for unironed fabrics.

Alternative Embodiments of the Invention

The compositions of the invention which contain a cationic softener and are suitable for use in an aqueous rinse bath may alternatively be introduced into an electrical dryer with the wet clothing to be dried. In this embodiment, the composition is conveniently adsorbed into a non-woven substrate or sheet made from polyester, polyamine or other material known in the art. The non-woven sheet which is impregnated with the fabric care composition is then added to the dryer with the wet clothes, and the composition is deposited onto the fabric surface via physical contact with the non-woven sheet.

In another alternative embodiment, the compositions of the invention may be applied to wet clothes directly via spray or immersion of the clothes in the undiluted product composition prior to drying. This application is followed by line or dryer drying of the clothes. The benefits which are described in the examples above will be similarly achieved using this method of application.

The compositions of the invention can be effectively used in various modes of washing and rinsing known in the art including hand washing and rinse of laundry as well as machine washing/rinsing of laundry.

What is claimed is:

1. An aqueous fabric care composition for use in the wash or rinse cycle of a washing machine for cleaning or softening of fabrics concomitant with providing improved benefits to treated fabrics relating to moisture absorption, fragrance deposition, soil removal, reduced wrinkling prior to ironing and better appearance after ironing, said composition comprising:

(a) from about 0.1% to about 30%, by weight, of a surfactant selected from the group consisting of anionic, nonionic and cationic surfactants, and wherein said surfactant is not derived from hydrazine;

(b) from about 0.1% to about 5% by weight of (i) a polymer which comprises a water-soluble polymerized acrylic acid or a water-soluble salt thereof; and (ii) hydroxyalkyl urea; and (c) balance water and adjuvants.

2. A fabric care composition according to claim 1 which comprises a cationic surfactant fabric softener.

3. A fabric care composition according to claim 1 wherein the hydroxyalkly urea is selected from the group consisting of N,N-bis(2-hydroxyethyl)urea; tetrakis(2-hydroxyethyl) urea; tris(2-hydroxyethyl)urea; N,N'-bis(2-hydroxyethyl) urea; N,N'-bis(3-hydroxypropyl)urea; N,N'-bis(4-hydroxybutyl)urea and 2-urea-2-ethyl-1,3-propanediol.

4. A fabric care composition according to claim 1 wherein the sum total number of equivalents of functional groups in the polymer to the number of equivalents of hydroxyl groups in the hydroxyalkly urea is from about 1:1 to about 100:1.

5. A method of treating fabric which cleans or softens the fabric concomitant with providing improved benefits relating to moisture absorption, fragrance deposition, soil removal, reduced wrinkling prior to ironing and better appearance after ironing, which method comprises:

(a) contacting the fabric in an aqueous wash or rinse bath with an effective amount of the fabric care composition of claim 1.

6. The method of claim 5 wherein said contacting occurs in the wash or rinse cycle of an automatic laundry washing machine.

7. The method of claim 5 wherein said fabric care compositions comprises a cationic surfactant fabric softener, and said contacting occurs in the rinse cycle of an automatic laundry washing machine or in aqueous rinse bath.

8. A dryer sheet for providing fabric care benefits to clothes dried in an electric dryer comprising:

(a) a substrate;

(b) a coating on said substrate for providing fabric care benefits to treated fabrics in the dryer, said coating consisting essentially of a fabric care composition in accordance with claim 1.

9. A dryer sheet in accordance with claim 8 wherein said substrate is a non-woven sheet material.

10. A dryer sheet in accordance with claim 8 wherein said fabric care composition comprises a cationic surfactant fabric softener.

11. A method of treating fabric which cleans or softens the fabric concomitant with providing improved benefits relating to moisture absorption, fragrance deposition, soil removal, reduced wrinkling prior to ironing and better appearance after ironing, which method comprises applying to the fabric an effective amount of a fabric care composition in accordance with claim 1.

12. The method of claim 11 wherein said fabric care composition is applied to fabric by a spray dispenser.

13. The method of claim 11 wherein said fabric care composition is applied to the fabric by immersion of the fabric into said aqueous fabric care composition.

* * * * *